US005369237A

United States Patent [19]

Mejerl et al.

[11] Patent Number: 5,369,237

[45] Date of Patent: Nov. 29, 1994

[54] ELECTRICAL SWITCH

[75] Inventors: Thomas Mejerl, Rottweil; Franz Vozeler-Pape, Tuttlingen, both of Germany

[73] Assignee: Marquardt GmbH, Rietheim-Weilheim, Germany

[21] Appl. No.: 9,754

[22] Filed: Jan. 27, 1993

[30] Foreign Application Priority Data

Jan. 28, 1992 [DE] Germany ..... 4202214

[51] Int. Cl.[5] ..... H01H 3/42

[52] U.S. Cl. ..... 200/524; 200/523; 200/243

[58] Field of Search ..... 200/523, 524, 525, 520, 200/243, 245

[56] References Cited

U.S. PATENT DOCUMENTS

| | | | |
|---|---|---|---|
| 3,406,589 | 10/1968 | Gaber | 74/503 |
| 3,824,362 | 7/1974 | Bury | 200/153 J |
| 3,914,570 | 10/1975 | Lockard | 200/524 |
| 4,357,511 | 11/1982 | Tenner et al. | 200/525 |
| 4,916,276 | 4/1990 | Sasaki | 200/524 |
| 4,956,529 | 9/1990 | Ueno | 200/524 |

FOREIGN PATENT DOCUMENTS

| | | |
|---|---|---|
| 1223507 | 6/1960 | France . |
| 2373863 | 7/1978 | France . |
| 2510808 | 2/1983 | France . |
| 515941 | 1/1931 | Germany . |
| 2411463 | 9/1975 | Germany . |
| 2715063 | 11/1977 | Germany . |
| 2217690B2 | 4/1980 | Germany . |
| 8616074.5 | 11/1986 | Germany . |
| 3545879A1 | 6/1987 | Germany . |
| 8600788.2 | 8/1987 | Germany . |
| 341934C2 | 6/1988 | Germany . |

*Primary Examiner*—Henry J. Recla
*Assistant Examiner*—David J. Walczak
*Attorney, Agent, or Firm*—Spencer, Frank & Schneider

[57] ABSTRACT

An electrical switch (1) is proposed on the actuator (4) of which, which can be moved in a housing (2), there are arranged contact bridges (8) which can be brought into contact with break contact surfaces (11) which are located, in turn, in a base (5) secured to the housing (2). Two guide curves (14, 15), which have different configurations and in which a pin (19, 20) respectively engages, are located on two mutually opposite surfaces of the actuator (4) which extend parallel to the direction of actuation. The two pins (19, 20) serving the purpose of the notching are coupled to one another by means of a connecting element (21) which is elastically deformed in sections during the movement by the different guidance of the two pins (19, 20).

14 Claims, 6 Drawing Sheets

ELECTRICAL SWITCH

BACKGROUND OF THE INVENTION

The invention relates to an electrical switch that includes an actuator movably guided in a switch housing and carrying contacts for making or breaking an electric connection with stationary contacts mounted in the switch. The actuator has a surface which extends parallel to the actuator movement and in which there is provided a guide curve having at least two latching positions. A pin rides in the curve upon movement of the actuator such that the actuator can be locked in on and off positions in the respective latching positions of the guide curve according to the preamble of patent claim 1.

Such electrical switches are used to switch electrical devices on and off by pressure operations the actuator locking home in the respective switch position. These switches are used, in particular, for household appliances, such as vacuum cleaners and the like.

Such an electrical switch whose actuator, which is movably guided in the housing and can be brought into two latched positions by means of pressure, has been disclosed in German Offenlegungsschrift 2,217,690. In the first latched position, the contact bridges arranged on the actuator do not touch the break contacts located in the housing, so that the switch is in the off position, while in the second latched position the contact bridges touch the break contacts, as a result of which the switch is located in the on position.

In order to fix the latched positions, this electrical switch has two identical heart-shaped guide curves arranged on mutually opposite sides of the actuator. Located on the sides of the housing assigned to the guide curves are two slots in which a gudgeon of a bolt engages. A further pin of the bolt engages, in turn, in the assigned guide curve, as a result of which the latched positions of the switch are fixed by the interaction of pin and guide curves.

It has proved to be disadvantageous in this switch that jamming of the gudgeon in the slot of the housing, or of the pin in the guide curve can occur in the event of tilting of the actuator. In both cases, there is then the risk of a lack of latching in the on or off position. This uncertain switching performance means, in turn, a defective operational reliability for the switch in question. Moreover, this switch is difficult to install because of the two bolts which are to be simultaneously inserted on the two sides of the housing.

SUMMARY OF THE INVENTION

It is the object of the invention to develop the switch mentioned at the beginning in such a way that reliable notching in the on and off positions is ensured and no maloperations occur.

This object is achieved by the invention, according to which the electrical switch has a switch housing movably receiving an actuator that carries a movable contact cooperating with a stationary contact held in the switch housing. The actuator has two opposite surfaces on which two curve guides of different configuration are provided. Two pins, supported in the switch housing, ride in the respective guide curves as the actuator moves. The two pins are interconnected by means of a connecting element which is elastically deformed by forces derived from the unlike guidance of the two pins by the guide curves. The guide curves determine a latched on position and a latched off position for the switch.

In a further embodiment of the switch according to the invention, the connecting element coupling the two pins engaging in the guide curve consists of a U-shaped bracket which is inserted into a corresponding receptacle in the base of the housing. It is therefore possible for the switch to be particularly simply installed by firstly providing the base with the break contacts, placing the bracket into the receptacle, and then setting up the actuator with the switching contacts in such a way that the pins on the U-shaped bracket engage in the guide curves and, finally, the housing is pushed over the actuator and the base, said actuator locking home in corresponding latching or snap connections on the base. In addition, given the use of the U-shaped bracket it is possible to eliminate an otherwise necessary additional spring element which serves as connecting element.

In a further advantageous embodiment of the invention, the terminals for the switch are provided with a U-shaped part which serves as a break contact surface. The U-shaped part is plugged onto correspondingly shaped webs in the base. As a result, the U-shaped part can be arranged in two different positions, so that the terminals can optionally emerge from the housing both downwards and to the side.

The advantages achieved with the invention consist, in particular in that the switch has a very low overall volume, and yet has a switching performance that is very operationally reliable and completely excludes maloperations. The actuator is also always positioned vertically in the on position, as a result of which tilting is reliably prevented. Because of the connecting element which couples the pins engaging in the guide curves, it is possible to eliminate complexly shaped bolts and associated slots in the housing for receiving the bolts. Rather, it is possible to select simple pins and connecting elements which can be produced from wire, so that the switch is cost effective and also simple to install. The possibility of arranging the terminals both downwards and at the side provides manifold possibilities for using the switch according to the invention, depending on the desired aim.

DESCRIPTION OF THE PREFERRED

Figure 1:
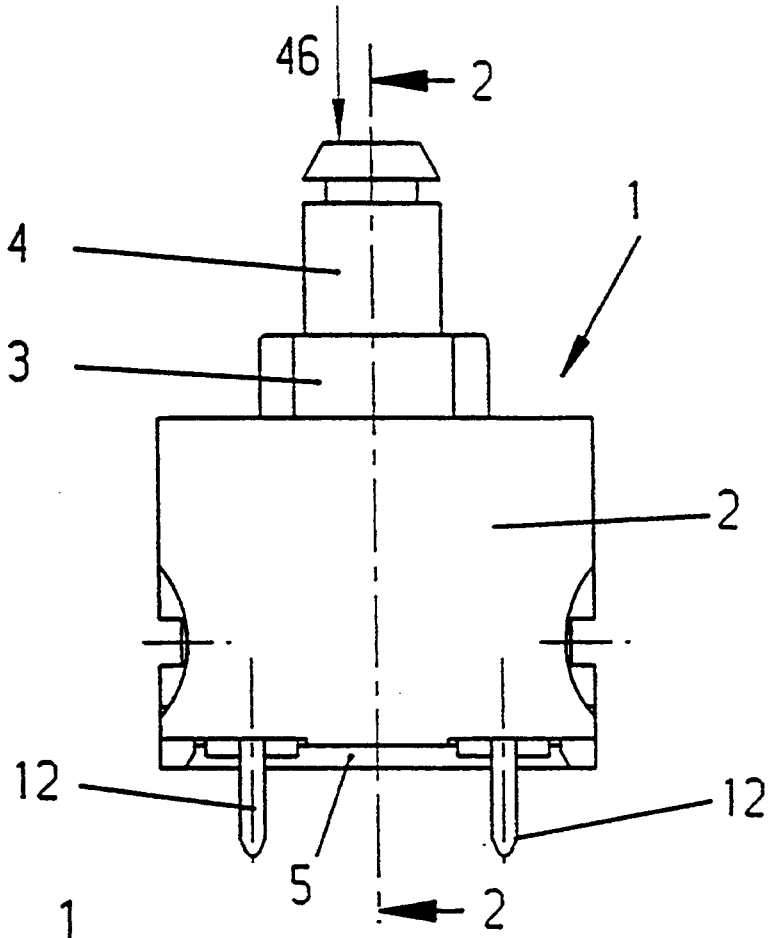
FIG. 1 shows a side view of the switch according to the invention.

As emerges from FIG. 1, the electrical switch 1, which can be actuated by pressure, is constructed as a double-pole on/off switch and can be latched in the on and off positions, has a housing 2 and a base 5 carrying the electrical terminals 12. Integrally formed on the base are webs 44 which are shown in more detail in FIG. 4 and have guide grooves in which corresponding counter parts 45 in the interior of the housing 2 engage. As a result, when installing the switch 1 the housing 2 can be pushed onto the base 5 and detachably secured to the latter by means of latching or snap connections known per se. Located on the housing 2 is a neck 3 which serves as a guide for an actuator 4.

Figure 2:
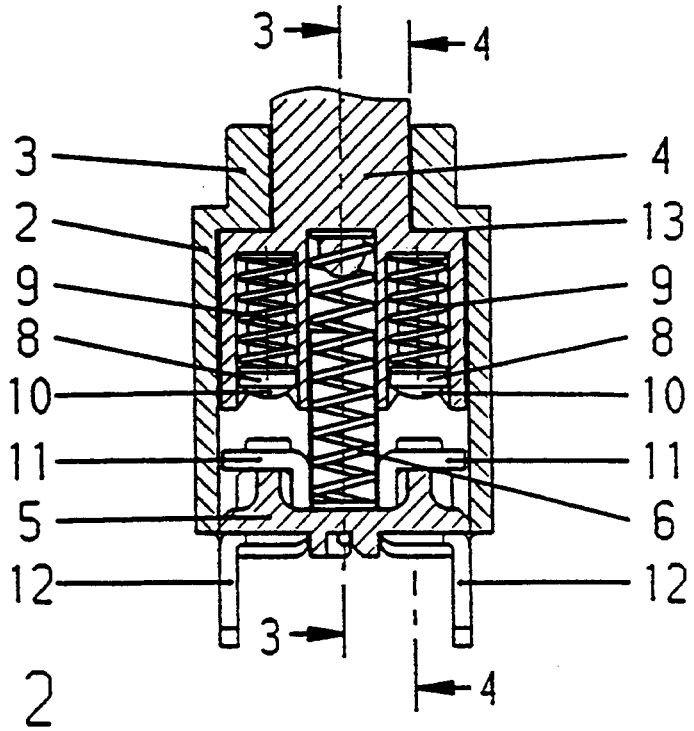
FIG. 2 shows a section along the line 2—2 in FIG. 1.
Figure 3:
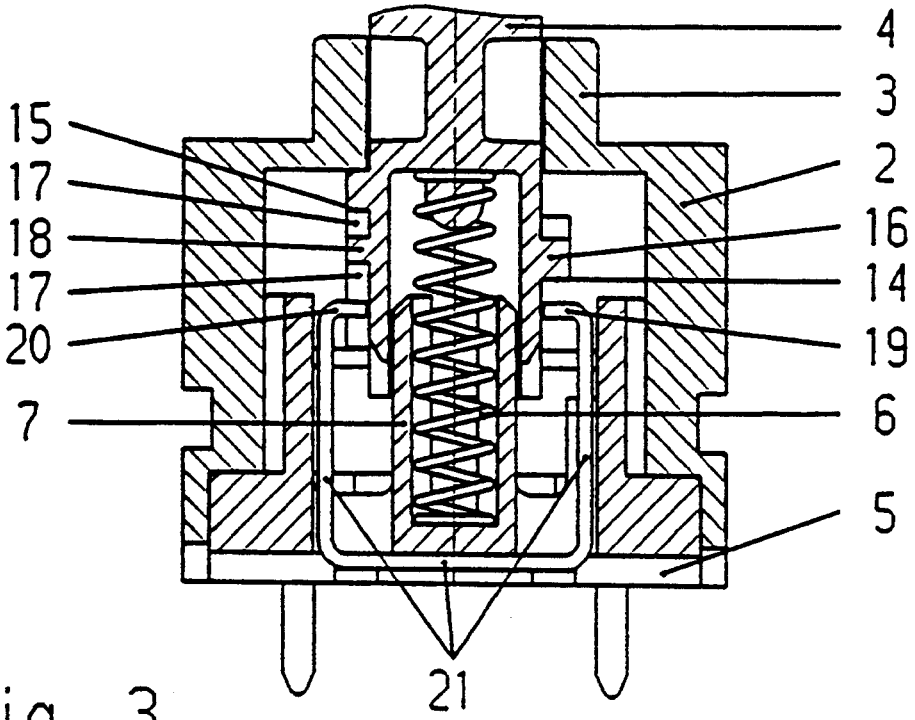
FIG. 3 shows a section along the line 3—3 in FIG. 2.

As may be seen from FIGS. 2 and 3, the actuator 4 can be moved against the pressure of a spring 6 which is located in a receptacle 7 arranged on the base 5. Two contact bridges 8, which are fitted with switching contacts 10 are elastically arranged on the actuator 4 by means of springs 9. The switching contacts 10 of the contact bridges 8 can be brought through movement of the actuator 4 in the event of the exertion of pressure in the direction of the arrow 46 (see FIG. 1) to bear against the break contact surfaces 11 of the electrical terminals 12, as a result of which an electrical connection is produced between the terminals 12, and thus the on position of the switch 1 is produced. When the actuator 4 is located in the off position of the electrical switch 1 shown in FIGS. 2 and 3, because of the spring pressure of the spring 6 the switching contacts 10 of the contact bridges 8 are at a certain distance from the break contact surfaces 11, so that the electrical connection is broken.

The electrical switch 1 has one latched position each in the off and in the on positions. The latched position in the off position is fixed due to the fact that because of the pressure of the spring 6 the actuator 4 with the shoulders 13 bears against corresponding surfaces of the neck 3 in the interior of the housing 2. Provided on the actuator 4 in order to fix the other latched position in the on position are two guide curves 14, 15 of differing shape on mutually opposite surfaces extending parallel to the direction of movement.

Figure 5:
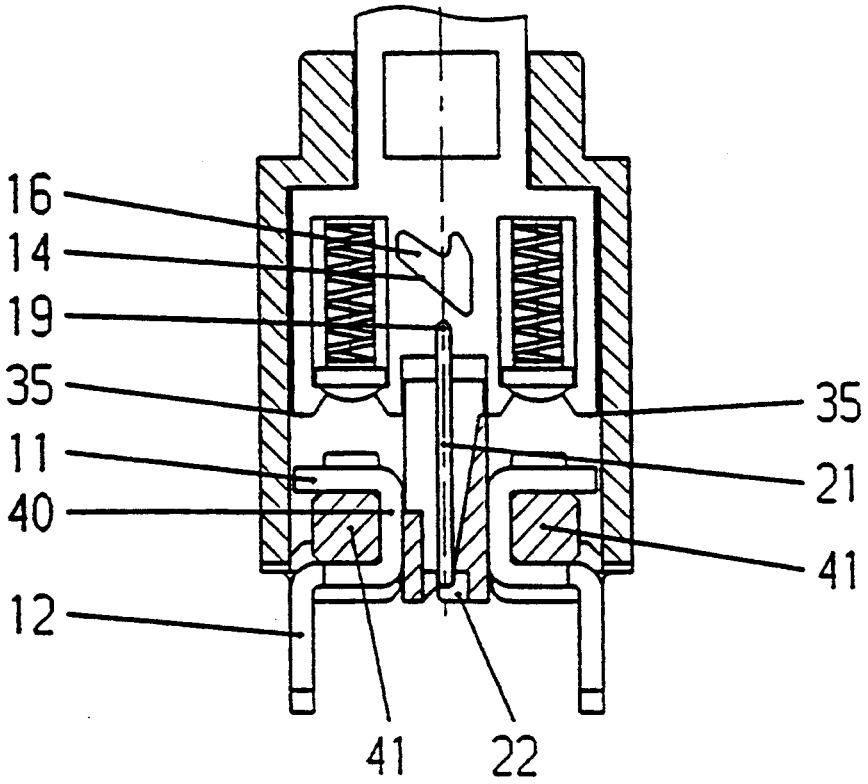
FIG. 5 shows a section along the line 5—5 in FIG. 4.

As can be gathered from FIGS. 3 and 5, the first guide curve 14 consists of a surface 16 which is raised on the actuator 4 and whose outer contour has the shape of a heart, which is why the surface 16 is also called a switching heart. The second guide curve 15 is formed by a surface 17 which is sunk on the actuator 4 and in the center of which an elevated, triangular surface 18 is located, and this is to be seen by comparing FIGS. 3 and 6. As emerges, furthermore, from FIG. 6, the inner contour of the guide curve 15 is essentially constructed in the shape of a heart.

Engaging respectively in the two guide curves 14 and 15 is a pin 19, 20. These two pins 19, 20 are coupled with one another by a connecting element 21. The connecting element 21 has in this exemplary embodiment the shape of a U-shaped bracket and is placed in a receptacle 22 on the base 5. As is to be seen in the present exemplary embodiment, the pins 19, 20 and the connecting element 21 can be produced from one piece by bending a spring wire. It is expediently possible to select a round cross section for the spring wire, but any other cross-sectional shape is also conceivable.

The mode of operation of the switch 1 according to the invention is shown in more detail in FIGS. 7 to 13, in which the guide curve 15 is to be seen in top view, and the guide curve 14, which is located, covered per se, on the opposite surface of the actuator 4, is represented by dashes. The two pins 19, 20 are represented by circles, and the connecting element 21 is omitted for reasons of clarity.

Figure 7:
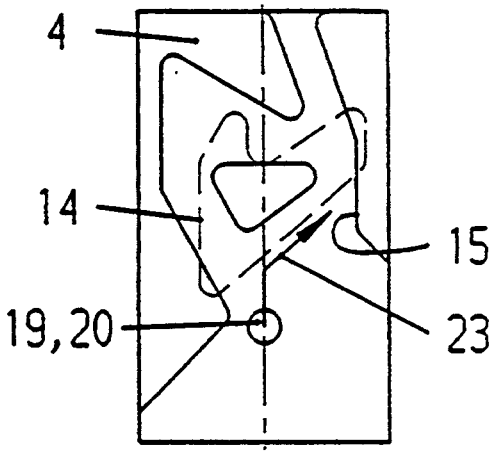
FIGS. 7 to 13 show sketches of the principle of the mode of operation of the switch in various actuating positions.
Figure 8:
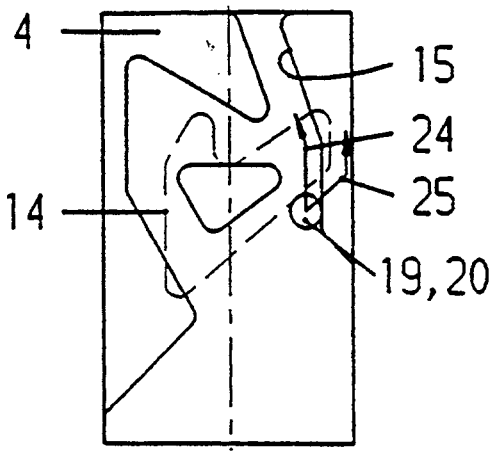

The latched position corresponding to the off position is to be seen in FIG. 7. The two pins 19, 20 are located opposite one another in the same position, which is approximately situated in the central plane of the actuator 4 below the two guide curves 14 and 15. As already mentioned, this latched position is fixed by the interaction of the spring 6 and the shoulders 13 with the housing 2.

If the actuator 4 is moved by pressure in the direction of the arrow 46 (compare FIG. 1), the pin 19 comes to bear against the guide curve 14 which is formed by the outer contour of the raised surface 16, and is deflected in the direction of the arrow 23 in accordance with the outer contour, which extends obliquely upwards. Because of the connecting element 21, the pin 20 is likewise deflected and, as is to be seen in FIG. 8, finally touches the inner contour of the guide curve 15. Approximately in this position of the pins 19, 20, the switching contacts 10 of the contact bridges 8 come to bear against the break contact surfaces 11 of the electrical terminals (compare also FIG. 2), as a result of which the electrical connection is produced.

Given further movement by pressure on the actuator 4, the pin 20 is then guided along the inner contour of the guide curve 15 essentially vertically upwards in the direction of the arrow 24. At the same time, the pin 19 is again deflected somewhat further in the oblique direction 23 and finally guided likewise vertically upwards along the outer contour of the guide curve 14 in accordance with the arrow 25. As may be seen with the aid of the arrows 24 and 25, the two pins 19, 20 are differently deflected because of the different shapes of the two guide curves 14, 15, so that the connecting element 21 is elastically deformed in this movement section. Due to this elastic deformation, the connecting element 21 constructed in the present exemplary embodiment as a U-shaped bracket is subjected to torsional stress. During this movement, the springs 9 of the contact bridges 8 (see FIG. 2) are simultaneously compressed, since the switching contacts 10 already bear against the break contact surfaces 11.

Figure 9:
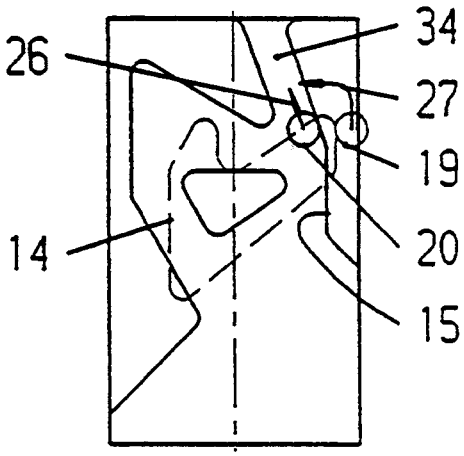
Figure 10:
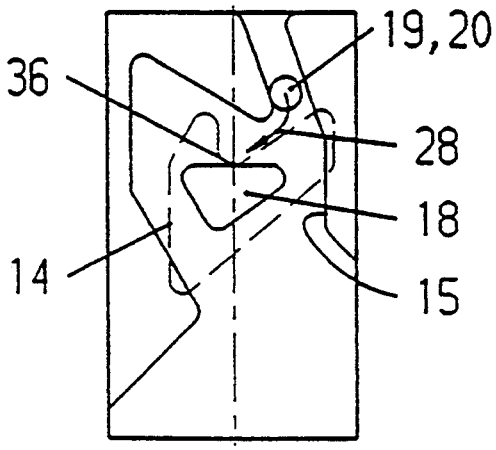

The two pins 19, 20 finally reach the position shown in FIG. 9. While the pin 20 moves there in the direction of the arrow 26 into the upper channel 34, because of the tension which is caused by the torsion of the U-shaped bracket the pin 19 springs back in the direction of the arrow 27 as far as the deflection corresponding to the pin 20, since the positive movement is then terminated by the guide curve 14. The downward movement of the actuator 4 is finally terminated by the stop of the lower surface 35 of the actuator 4 at the base 5 (see also FIG. 5 in this connection).

In this position, there is now a weakening of the pressure on the actuator 4, so that because of the elastic force of the spring 6 said actuator is again moved upwards against the arrow 46 in FIG. 1. In this case, however, the compressed state of the springs 9 ensures that the switching contacts 10 bear against the break contact surfaces 11. During this upward movement of the actuator 4, the pin 19 now comes to bear against the outer contour, extending obliquely downwards, of the guide curve 14, and moves along the latter in the direction of the arrow 28, as is to be seen in FIG. 10, until the upper depression 36 in the guide curve 14 is reached. The pin 20 is guided along by the connecting element 21 in a corresponding deflection to the pin 19, and upon reaching the depression 36 likewise comes to bear against the triangular surface 18 due to the pin 19. Upon reaching the upper depression 36 due to the pin 19, the electrical switch 1 is located in the second latched position, which is shown in more detail in FIG. 11 and corresponds to the on position.

Figure 11:
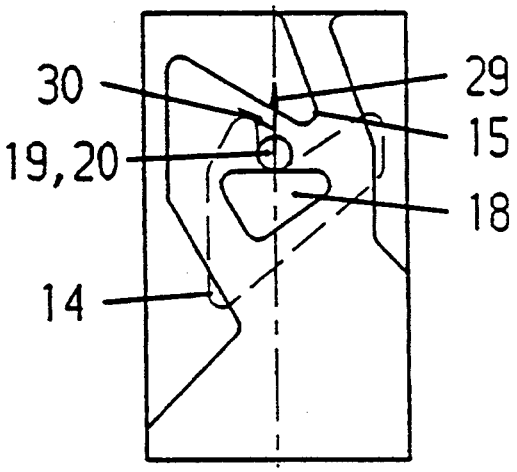
Figure 12:
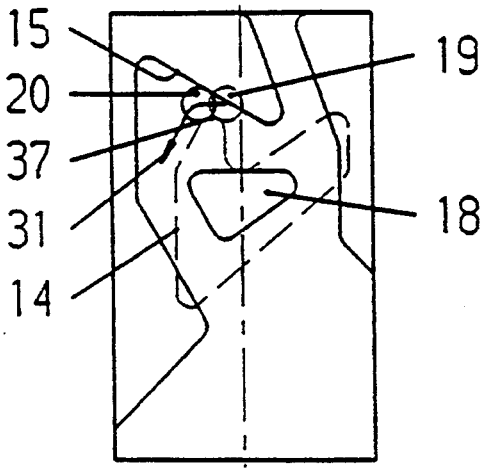
Figure 13:
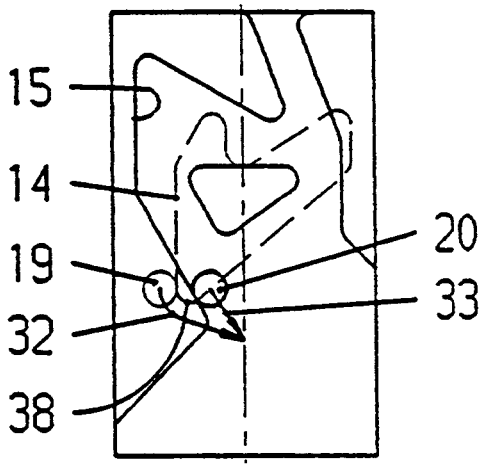

If the electrical switch 1 located in the on position is to be switched off, the actuator 4 is once again pressed in the direction of the arrow 46 according to FIG. 1, as a result of which the pin 19 is guided along the outer contour, extending vertically upwards, of the guide curve 14 in the direction of the arrow 29, as is to be seen in FIG. 11. At the same time, the pin 20 is guided vertically upwards until coming to bear against the inner contour of the guide curve 15, and guided along there obliquely upwards in the direction of the arrow 30. In this case, the connecting element 21 is, in turn, elastically deformed. In the present exemplary embodiment, the U-shaped bracket is subjected to torsional stress, since by contrast with the pin 19, which is guided in the vertical direction 29, the pin 20 is deflected further in the direction of the arrow 30, as is shown in FIG. 12. If the upper point 37 of the guide curve 14 has been reached by the pin 19, the latter snaps into the same position as the pin 20 because of the torsional tension. The electrical connection still exists in this position, that is to say the switching contacts 10 continue to bear against the break contact surfaces 11. At the same time, the movement of the actuator 4 in the direction of the arrow 46 is, in turn, terminated in this position by the lower surface 35 bearing against the base 5.

Upon release of the actuator 4 or weakening of the pressure on the actuator 4, the latter moves upwards because of the force of the spring 6 and opposite to the direction of the arrow 46 according to FIG. 1. The pin 19 is in this case moved along the outer contour of the guide curve 14 in the direction of the arrow 31 and subsequently perpendicularly downwards. At the same time, the switching contacts 10 are raised by the break contact surfaces 11 (see FIG. 2), the electrical connection being broken again. The pin 20 is guided along in the same position during this movement, until it finally comes to bear against the inner contour of the guide curve 15 and is moved there obliquely downwards in the direction of the arrow 33 in accordance with FIG. 13. Since, now, the pins 19 and 20 are moved anew along the different guide curves 14 and 15, the U-shaped bracket is once again subjected to torsional stress in this movement section, so that upon reaching the lower point 38 of the guide curve 14 the pin 19 snaps along the direction of the arrow 32 into the first latched position corresponding to the off position of the electrical switch 1.

In some cases, a pressure point which is clearly detectable during switching on is desired in such a switch. This point can be realized by constructing the distance between the inner contour of the guide curve 15 and the outer contour of the triangular surface 18 such that at the constriction 39 located in the switching-on path, which is traversed by the pin 20 from the latched position corresponding to the off position into the latched position corresponding to the on position, and is to be seen in more detail in FIG. 6 said distance is equal to or slightly smaller than the cross-sectional width or, in the case of a round cross section, the diameter of the pin 20. If the pin 20 then reaches the constriction 39, the latter must be brought through the constriction 39 onto the actuator 4 by means of increased pressure. After the pin 20 has passed the constriction 39, a smaller pressure once again suffices for further movement of the actuator 4, so that the typical pressure point performance exists.

Figure 4:
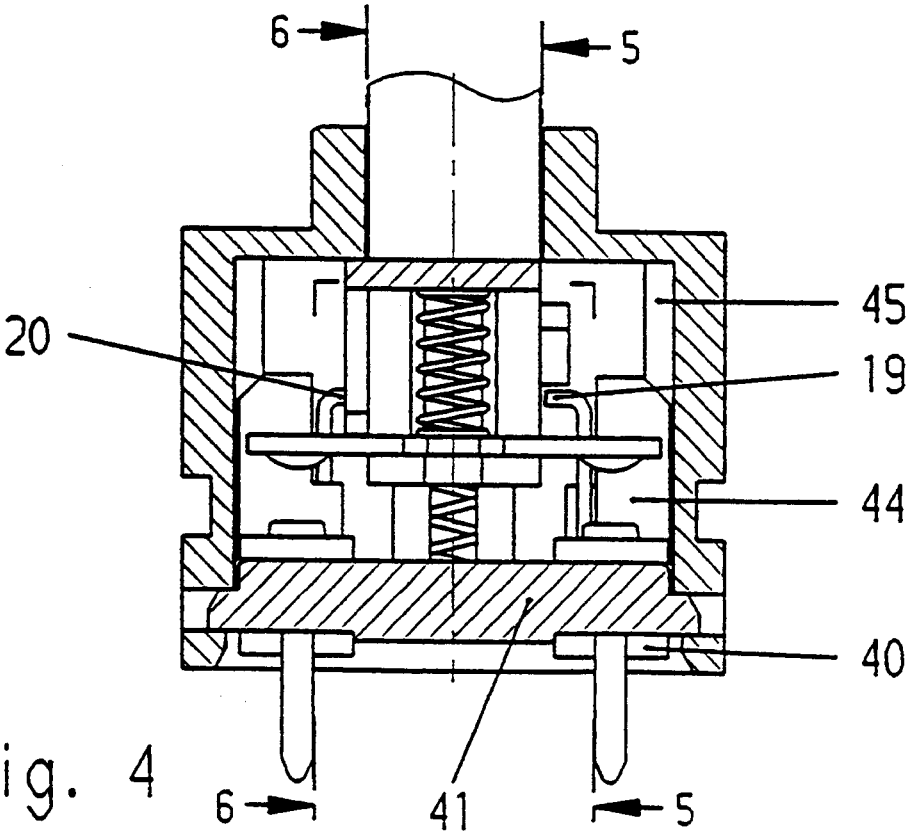
FIG. 4 shows a section along the line 4—4 in FIG. 2.
Figure 6:
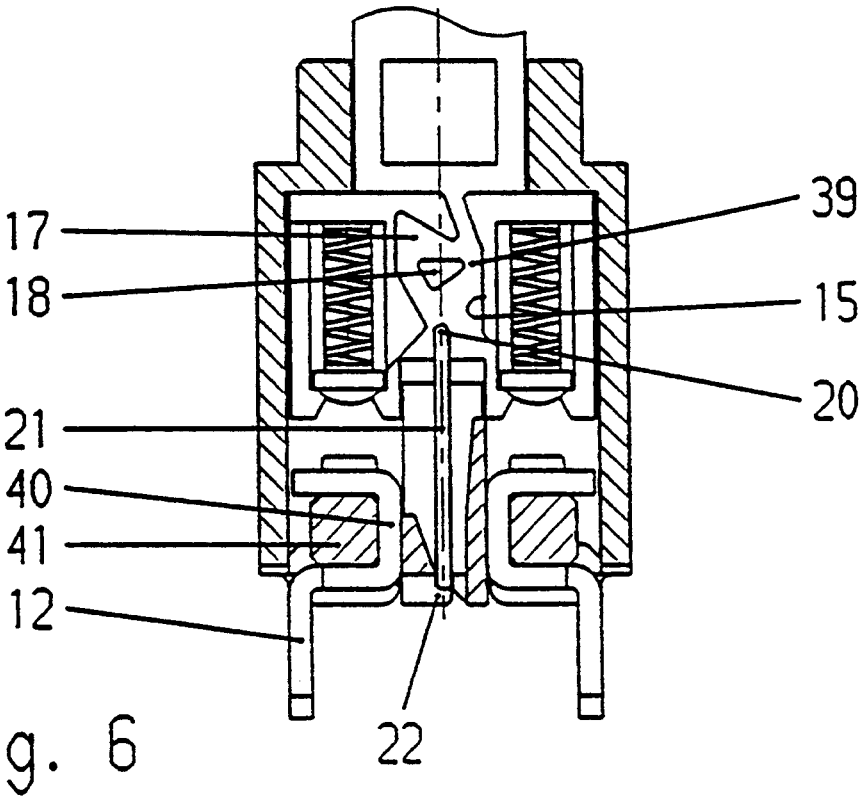
FIG. 6 shows a section along the line 6—6 in FIG. 4, the metal parts being represented unsectioned in FIGS. 2 to 6 for the purpose of better illustration.
Figure 14:
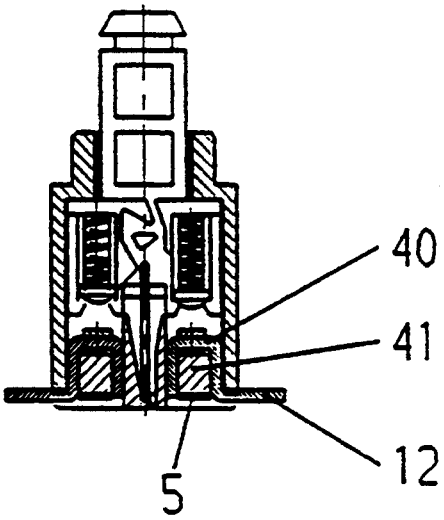
FIG. 14 shows a section through a further design variant for the switch.

As is to be seen in more detail in FIGS. 4 to 6, the electrical terminals 12 are provided with a U-shaped part 40 which is widened as compared with the terminal 12, the terminal 12 leaving a leg of the U in a cranked off fashion. The break contact surfaces 11 are formed by the other leg of the U. The U-shaped part 40 is plugged on a correspondingly shaped web 41 of the base 5. It is thereby possible to plug on the U-shaped part 40 in such a way that the terminals 12 project vertically downwards from the housing 2, in order to be connected to the terminal printed conductors on a printed circuit board by means of plating through. The U-shaped part 40 can also be plugged onto the web 41 in the way to be seen in FIG. 14. The terminals 12 then project sideways at the bottom on the housing 2, as a result of which this switch is particularly suitable for surface mounting on a printed circuit board. In this case, the break contact surfaces 11 are formed by the base of the U. It remains to be stressed that it is possible to eliminate corresponding holes in the housing 2 for leading through the terminals 12, since the latter project from the switch 1 at the base 5, which shuts off the housing 2 below.

Figure 15:
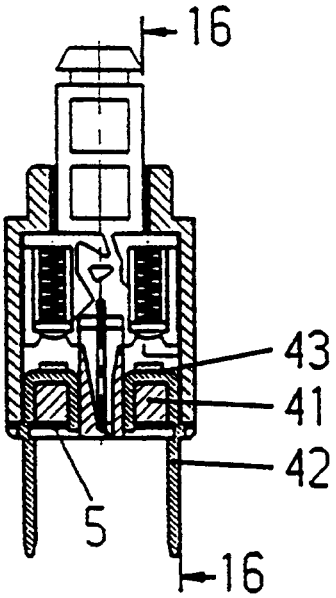
FIG. 15 shows a section through yet another embodiment.
Figure 16:
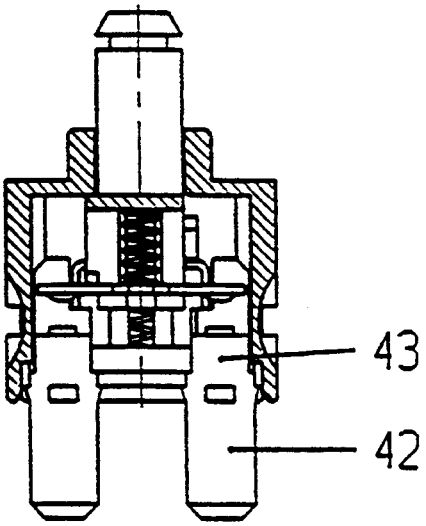
FIG. 16 shows a section along the 16—16 in FIG. 15.

A further variant of the electrical terminals of the switch 1 is to be seen in FIG. 15. In this case, the terminals are not cranked off. The terminal 42 consists of a direct extension of a leg of the U-shaped part 43, which is plugged on the web 41. Terminals 42 constructed in such a fashion are particularly easy to manufacture in terms of production engineering. As is further to be seen in FIG. 16, the terminals 42 of this variant have essentially the see width as the U-shaped part 43.

The invention is not restricted to the exemplary embodiment described. This, instead of arranging the two guide curves on the actuator, it is also within the scope of the invention to arrange them on the inner surfaces of the housing and to arrange the connecting element for the pins on the actuator. However, it is important in the exemplary embodiment that the two guide curves have a different shape, as a result of which the connecting element coupling the two pins is elastically deformed in sections during the movement of the actuator. Due to this elastic deformation, a force is exerted on the respective pin, as a result of which, as described with the aid of FIGS. 7 to 13, the latter is moved in the direction of the travel, so that maloperations are reliably excluded.

We claim:

1. An electrical switch comprising (a) a switch housing;

(b) a stationary electric contact mounted in said switch housing;

(c) an actuator mounted in the switch housing and guided therein for displacements in opposite directions relative to said switch housing to assume several positions; said actuator having opposite first and second surfaces extending parallel to said directions;

(d) first and second guide curves provided in said first and second surfaces, respectively; said first and second guide curves being of unlike course as viewed in said directions;

(e) a movable electric contact carried by said actuator and being in engagement with said stationary electric contact in an on position of said actuator and being separated from said stationary electric contact in an off position of said actuator;

(f) first and second pins extending into said first and second guide curves, respectively, to be guided by said first and second guide pins upon movement of said actuator; and (g) a resilient connecting element coupling said first and second pins to one another; said connecting element being held in said switch housing such that said connecting element is elastically deformable upon movement of said actuator by forces exerted by said first and second guide curves on said first and second pins, whereby a restoring force is exerted on said first and second pins by said connecting element; said first and second pins cooperating with said first and second guide curves for determining first and second latched positions of said actuator; in said first latched position said stationary and movable electric contacts are in engagement with one another and in said second latched position said stationary and said movable electric contacts are separated from one another.

2. The electrical switch as defined in claim 1, wherein said connecting element is a U-shaped member and further wherein said first and second pins are carried at respective free ends of said U-shaped member.

3. The electrical switch as defined in claim 2, wherein said connecting element and said first and second pins constitute a single-piece component.

4. The electrical switch as defined in claim 3, wherein said single-piece component is a spring wire.

5. The electrical switch as defined in claim 4, wherein said spring wire has a round cross section.

6. The electrical switch as defined in claim 1, wherein said first guide curve comprises a raised surface of said first surface of said actuator; said first guide curve having an outer contour of heart-shaped configuration; and further wherein said second guide curve comprises a depressed surface of said second surface of said actuator; said second guide curve having an inner contour of heart-shaped configuration.

7. The electrical switch as defined in claim 6, further comprising a raised triangular surface positioned in a center of said depressed surface.

8. The electrical switch as defined in claim 7, wherein said second guide curve has a switching-on path in which said second pin is guided when said actuator is moved toward said on position; further comprising a constriction situated between an outer contour of said triangular raised surface and said inner contour of said second guide curve; said constriction having a width being at the most as large as a cross-sectional dimension of said second pin, whereby a pressure point is provided for a switch-on operation of said actuator.

9. The electrical switch as defined in claim 1, wherein said switch housing comprises (a) a housing part having an open end;

(b) a base closing off said open end and carrying said stationary contact;

(c) an interfitting groove-and-tongue connection provided on said base and said housing part for effecting a fit between said base and said housing part; and (d) snap means for detachably securing said base to said housing part.

10. The electrical switch as defined in claim 9, wherein said connecting element is a U-shaped member and further wherein said first and second pins are carried at respective free ends of said U-shaped member; further wherein said base includes a receptacle; said U-shaped member being positioned in said receptacle.

11. The electrical switch as defined in claim 9, further comprising a U-shaped part held in said base by webs formed therein; said U-shaped part having first and second legs; said stationary contact being formed on said first leg; further comprising an electric terminal strip being attached to and extending from said second leg.

12. The electrical switch as defined in claim 11, wherein said electric terminal strip is a linear continuation of said second leg.

13. The electrical switch as defined in claim 11, wherein said electric terminal strip extends at an angle from said second leg.

14. The electrical switch as defined in claim 11, wherein said electric terminal strip projects outwardly from said housing.

* * * * *